United States Patent [19]

Contreras, Sr.

[11] Patent Number: 4,518,092

[45] Date of Patent: May 21, 1985

[54] MOLDED CONTAINER WITH LIVING HINGES

[76] Inventor: Joseph P. Contreras, Sr., Brockden Dr., Mendam, N.J. 07945

[21] Appl. No.: 571,787

[22] Filed: Jan. 18, 1984

[51] Int. Cl.[3] ..... B65D 39/00

[52] U.S. Cl. ..... 220/20.5; 220/22; 220/339; 206/581; 206/823

[58] Field of Search ..... 220/20, 20.5, 22, 23.8, 220/339; 206/581, 229, 235, 823, 37, 38

[56] References Cited

U.S. PATENT DOCUMENTS

| | | | |
|---|---|---|---|
| 638,126 | 11/1899 | Kampfe et al. | 220/22 |
| 2,344,682 | 3/1944 | Dodge et al. | 220/20.5 X |
| 4,331,168 | 5/1982 | Hatakeyama | 206/581 X |
| 4,463,869 | 8/1984 | Lewis | 220/339 X |

*Primary Examiner*—Steven M. Pollard

*Attorney, Agent, or Firm*—Daniel H. Bobis

[57] ABSTRACT

A single integrally injection molded container or compact made of any suitable thermoplastic synthetic polymer composition material has an elongated base assembly which defines a storage compartment and a fully enclosed side compartment in general alignment and communication therewith. A cover is pivotally connected to the base assembly by a first living hinge and is movable from an open position to overlie and close the storage compartment in the base assembly, an end closure is pivotally connected to the base assembly by a second living hinge and is movable from an open position to close the end of the side compartment remote from the storage compartment, the side compartment is provided with bracket means to hold a brush or applicator and when the cover is in the closed position an aligned opening permits the holder of the brush or applicator to extend into and to overlie the storage compartment to enable the brush or applicator to be stored in the container when not in use.

7 Claims, 15 Drawing Figures

MOLDED CONTAINER WITH LIVING HINGES

BACKGROUND OF THE INVENTION

This invention relates generally to containers and more particularly to a one piece molded container adapted for holding cosmetics such as mascara and in which the various closure elements are connected by so called living hinges established from a flexible thermoplastic synthetic polymer composition materials from which the molded containers are made.

It is known in the art that the injection molding of containers utilizing a thermoplastic polymer composition material provides a cheap way for fabricating such containers particularly compacts which are used in the cosmetic industry.

It is also known that in the injection molding of such containers or compacts that coacting elements such as the base unit and its associated cover may be molded as a single unit to provide a hinge therebetween of the same plastic material which hinge because of the resilient properties is particularly advantageous because it becomes more flexible with use and does not break under bending failure due to flexing of the hinge during the life of the compact. These hinges are known in the art as "living hinges".

This construction is advantageous because it eliminates the need for a separate connecting element between the base unit and the cover heretofore utilized in conventional containers or compact construction.

Containers having such living hinges are shown for example in U.S. Pat. Nos. 3,954,179; 4,011,940 and 4,401,230.

The present invention like these prior art devices relies on the characteristics of the thermoplastic synthetic polymer composition materials, for example polypropylene, high density polyethylene, and a resin material sold in the commercial marketplace under the trademark "K-RESIN" by Phillips Petroleum Corporation, from which the container or compartment is molded to enable an elongated container to be formed by a single injection molded step which provides not only a base assembly and its associated cover with a connecting living hinge but additionally a separate end closure with a connecting living hinge to enable a fully enclosed side compartment to be molded which is aligned and adjacent to the main storage compartment formed by the base assembly and its associated cover.

The improved container or compact in accordance with the present invention is particularly adapted for holding both cosmetics such as mascara and the applicator such as a brush, the mascara being stored in a storage compartment in the base assembly where access thereto is easily achieved by pivoting the cover associated with the base assembly from closed to open position and vice versa, the cover being provided with a self contained mirror therein. Access to and replacement of the applicator is also easily achieved when the cover is in the open position.

SUMMARY OF THE INVENTION

Thus, the present invention covers an injection molded container formed from a synthetic polymer composition material which includes a base assembly defining at least one storage compartment, and an aligned enclosed side compartment adjacent and in communication therewith. A cover member is connected to the base assembly by means of a first living hinge and is disposed to move from opened to closed position and vice versa with respect to the storage compartment, the said cover member having a detachable latch means for holding the closure member to the base assembly in the closed position, means on the base assembly forms an enclosed side compartment disposed in general alignment with said storage compartment and in communication with the storage compartment at one end when the closure member is in the closed position. An end closure is connected to the base assembly by means of a second living hinge at the end of the side compartment remote from the end in communication with the storage chamber, and said end closure has a latch means for generally locking the second closure member in the closed position.

Accordingly, it is an object of the present invention to provide an improved injection molded container having a base assembly with at least one storage compartment and one fully enclosed side compartment in general alignment at one end therewith, a cover for the storage compartment in the base assembly and an end closure for the side compartment are connected to the base assembly by living hinges.

It is another object of the present invention to provide a single injection molded elongated container with a storage compartment and an aligned fully enclosed side compartment wherein the cover and end closures are connected in assembled position thereon by means of a living hinge, and the end closure enables the injection molded container to be molded as a single unit.

It is still another object of the present invention to provide a single injection molded elongated container with at least one storage compartment and an aligned fully enclosed compartment adjacent the storage compartment which includes a base assembly and an associated cover to form the storage compartment and an end closure for the enclosed compartment, the cover and the end closure are connected to the base asembly by a living hinge and the end closure enables the formation of the fully enclosed compartment because means are provided to latch and lock the end closure in the closed position to generally seal the enclosed compartment at the end remote from the storage compartment.

It is still another object of the present invention to provide a single injection molded elongated container wherein the molding of an enclosed compartment in a single molding step is accomplished by providing an end closure having a living hinge at one end of the molded container which end closure is movable to a generally latched and locked position to seal the outer open end of the enclosed compartment.

It is still another object of the present invention to provide a single injection molded elongated container having an enclosed compartment for storing brushes or the like applicators covered with the remnants of cosmetic or the like materials which can stain or spot clothing hands or skin of the user of the material in the container.

These and other objects and advantages are best understood by reference to the following description taken in conjunction with the accompanying drawings:

DESCRIPTION OF A PREFERRED EMBODIMENT

Figure 1:
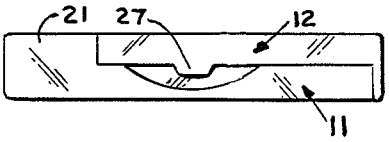
FIG. 1 is a front elevational view of an elongated integrally injection molded container in accordance with the present invention.

Referring to the drawings, FIGS. 1 to 6 show that the improved injection molded container in accordance with the present invention generally designated 10 has a elongated generally rectangular box like shape formed by a base assembly 11 and a cover 12 pivotally connected to the base assembly 11 by means of a first living hinge 13.

The container 11 is further provided with an end closure as at 14 which is also connected to the base assembly by a living hinge 15 as is shown in FIGS. 7, 8, 11 and 11*a*.

The container 10 is formed as a single integral monolithic blank by an injection molding process using any suitable type of thermoplastic synthetic polymer composition material examples of which are polypropylene, high density polyethylene, and the resin available in the commercial marketplace and sold under the trademark "K-RESIN" by Phillips Petroleum Corportion. Injection molding processes are well known and therefore do not have to be more fully described to those skilled in the art. However the important factor in the use of such injection molding process to the present invention is that by the use of proper synthetic polymer composition materials the pivotally connected cover and end closure can be simultaneously molded without the necessity of providing a separate hinge element or means for connecting the cover and end closure to the base assembly.

Referring further to the drawings, FIGS. 7 to 12 show that the base assembly 11 has at least one storage compartment as at 16 extending from one end of the container 10 to a medial point short of the opposite end. Compartment 16 is defined by the bottom 18, side walls 19*a* and 19*b* and end walls 20*a* and 20*b*. Compartment 16 will receive the cosmetic material therein such as mascara in any suitable moist cream, cake or other form in which the same is utilized so that it can be applied as by a wand or brush type applicator.

The bottom 18 and side walls 19*a* and 19*b* extend beyond the end wall 20*b* and are merged into or form part of an annular enclosure 21 which defines a fully enclosed side compartment 21*a* adjacent to and in alignment with the storage compartment but separated partly therefrom by the end wall 20*b* so that an opening is provided at the end adjacent to the storage compartment which will permit communication with the storage compartment for the reasons which will be clear from the description set forth below.

The cover 12 forms a space 16*a* which is generally the same size and shape as the storage compartment 16. Space 16*a* is defined by a top 22, side members 23*a* and 23*b* and end members 24*a* and 24*b*. Thus, when the closure is pivoted on the living hinge 13 from the open position as shown in FIGS. 7 and 8 to the closed position as shown in FIGS. 1 to 6, 9 and 10, the respective lower faces of the side walls 23*a* and 23*b* and end walls 24*a* and 24*b* of the cover and the upper faces of the side walls 19*a* and 19*b* and end walls 20*a* and 20*b* of the base assembly will engage and snugly fit together and the cosmetic materials will be securely confined in the storage compartment so that the cosmetic will not escape therefrom during movement of the container 10.

Cover 12 is connected to the base assembly 11 by means of the convenient one piece living hinge 13 which advantageously extends substantially the full length of the compartment 16. Living hinge 13 is formed from a properly formulated and moldable synthetic material which becomes more flexible with use and therefore does not break from bending fatigue as is common in other types of more brittle and less flexible materials, all of which is shown in FIGS. 2, 7, 8 and 8*a* of the drawings.

Figure 8:
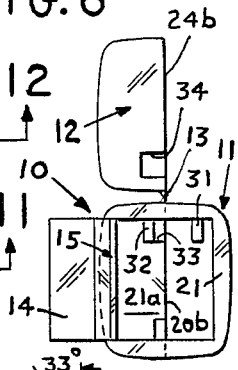
FIG. 8 is a left end view of the injection molded container as shown in FIG. 7.
Figure 8A:
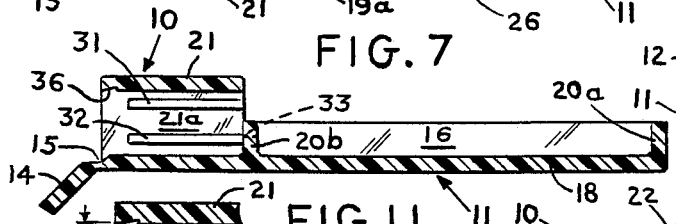
FIGS. 8*a* is an enlarged fragmentary cross-sectional view of the living hinge between the cover and the base assembly of the injection molded container shown in FIG. 8.

By reference to FIG. 8*a*, the living hinge 13 is shown as molded to the base assembly 11 and to the cover 12 by shaped enlarged connecting sections as at 13*a* and 13*b* respectively on opposite sides of the living-hinge 13. These shaped enlarged connection sections 13*a* and 13*b* are preferably formed at an angle of 33°. It has been found that this angle produces in the living hinges thus formed optimum elasticity and resilience for the life of the living hinge.

Figure 10A:
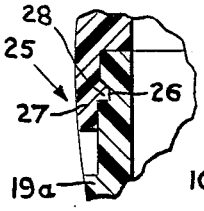
FIG. 10*a* is an enlarged fragmentary cross-sectional view of the latch between the cover and the base assembly of the injection molded container shown at FIGS. 1 and 10.
Figure 7:
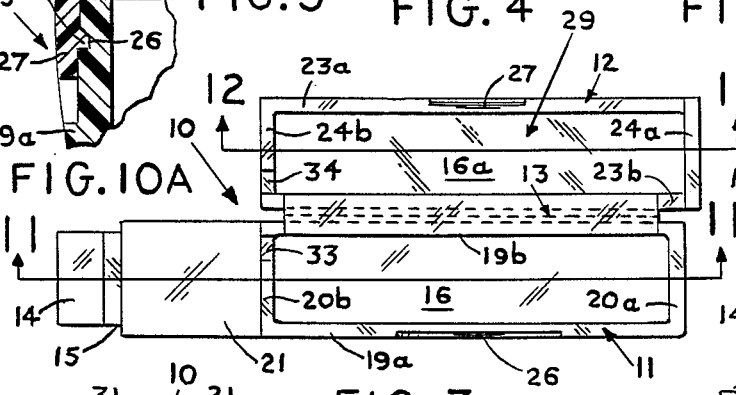
FIG. 7 is a top view of the injection molded container shown in FIG. 1 with the cover and the end closure shown in the open position.
Figure 10:
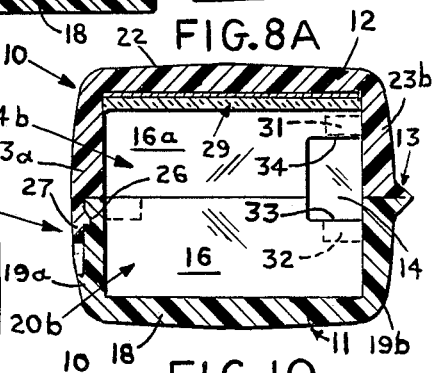
FIG. 10 is a cross-section taken on line 10—10 of FIG. 9.

When the cover 12 is pivoted for engagement with the sides 19*a* and 19*b* and the ends 20*a* and 20*b* of the base assembly as above described, the cover can be releasably connected by means of a detachable latch or snap lock member generally designated 25 and shown in FIGS. 7, 10 and 10*a* of the drawings. Thus, the side 19*a* of the base assembly 11 is shown as having a recess as at 26 formed on the exterior face thereof. The side wall 23*b* of the cover 12 is shown as having a latch 27 which has projection 28 portion shaped to fit and engage into the recess 16 as is shown in FIG. 10 of the drawings. The projection on the latch 27 engages the recess 26 when the cover 12 is moved into closed position, this interengagement providing alignment and positioning of the cover 12 in the closed position, as is shown in FIG. 10*a* of the drawings. The side 24*b* of the cover 12 has a sufficient length to overlie the side 20*a* as is shown in FIGS. 1, 2, 4, 6, 7 and 9 of the drawings and further acts as a seal against seepage of the cosmetics in the compartment 16 when the cover 12 is in the closed position.

Figure 12:
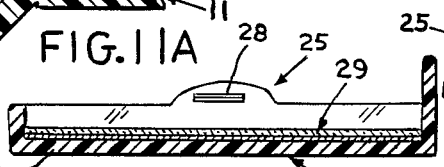
FIG. 12 is a longitudinal section taken on line 12—12 of FIG. 7.
Figure 9:
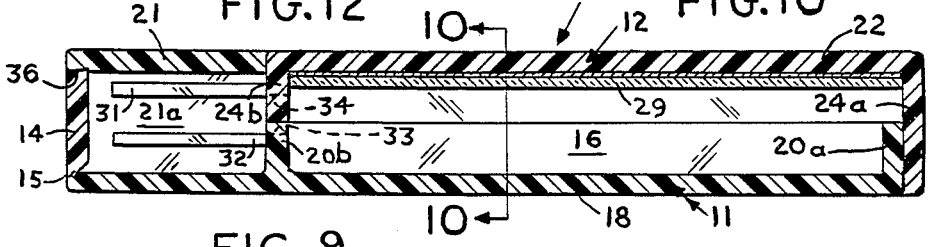
FIG. 9 is a longitudinal section taken on line 9—9 of FIG. 5.

The space 16*a* formed in cover 12 will have sufficient depth to permit a mirror 29 to be affixed as by a suitable adhesive on the inner wall thereof as is shown in FIGS. 9, 10 and 12 of the drawings.

The end or compartment 21*a* is provided with spaced brackets 31 and 32 on one inner side wall thereof for holding a mascara brush or applicator not shown. Brackets 31 and 32 coact with the end wall 20*b* on the base assembly between the storage compartment 16 and the side compartment 21*a* so as to permit the handle of the mascara brush or applicator, not shown, to extend and overlie the storage compartment 16. Thus, as shown in FIGS. 7, 8, 9, 10 and 11, the end wall 20*b* on the base assembly between the storage compartment 16 and the side compartment 21*a* and the end wall 24*b* on the cover are provided with notches respectively as at 33 and 34 which will be in alignment with each other when the cover 16 is moved to the closed position so that the handle of the mascara brush or applicator is free to extend into the section or space 16*a* in the cover where it can overlie the storage compartment. This provides a simple and convenient location for storing the applicator when the same is not in use. Those skilled in the art will readily recognize that such applicators are coated with residual materials which can stain or spot clothing, skin and hands of the user unless properly stored.

Figure 3:
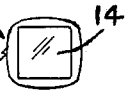
FIG. 3 is a left end view of the injection molded container shown in FIG. 1.
Figure 2:
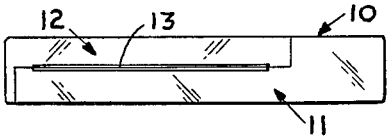
FIG. 2 is a back elevational view of the injection molded container shown in FIG. 1 showing one of the living hinges between the cover member and the base assembly.
Figure 5:
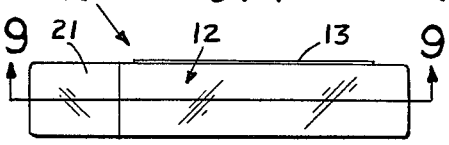
FIG. 5 is a top view of the injection molded container shown in FIG. 1.
Figure 4:
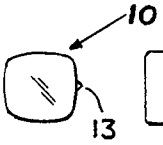
FIG. 4 is a right end view of the injection molded container shown in FIG. 1.
Figure 6:
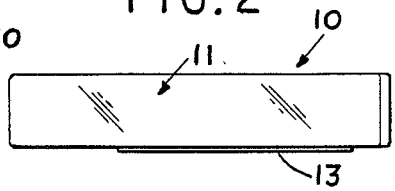
FIG. 6 is a bottom view of the injection molded container shown in FIG. 1.

The end opening 35 for the end compartment 21*a* remote from the end thereof adjacent to the storage compartment 16 is closed by means of the closure member 14 which is pivotally connected to the extended portion of the bottom 18 on the base assembly 11 by means of the second living hinge 15 which extends transversely of the width of the compartment 21*a* as is shown in FIGS. 3, 7 and 8 of the drawings.

Figure 11:
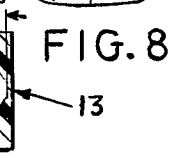
FIG. 11 is a longitudinal section taken on line 11—11 of FIG. 7.
Figure 11A:
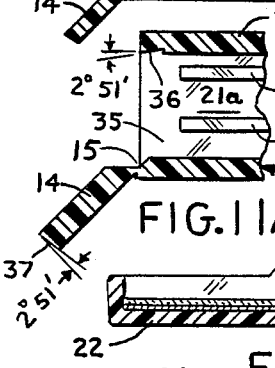
FIG. 11*a* is an enlarged fragmentary cross-sectional view of the end closure showing the living hinge and the latch for locking the end closure in the closed position.

The end closure 14 can be pivoted from open to closed position on the living hinge 15 and is held in closed position by means of a second latching assembly formed in the upper wall of the annular enclosure 21 adjacent the periphery of the opening 35 for the side compartment 21*a* as is shown in FIGS. 11 and 11*a*. Opening 35 is undercut as at 36 and the end of the end closure 14 cut on a bias as at 37 so that when the end closure 14 is moved into engagement with the undercut 36 due to the elasticity of the material it will snap and generally lock into engagement in the closed position. The end closure 14 in the closed position will also provide a seal for the fully enclosed end or side compartment 21*a*. The undercut 36 can be at an angle of about 3°–5° and preferably 2°51″. A similar angle is provided for the biased end 37 of the end closure 14.

The construction of the end closure 14, enables the container in accordance with the present invention to be injection molded as a single unit because it permits initially the molding of the fully enclosed end or side compartment 21*a* and thereafter when the container is to be used allows for the sealing of the open side of the end or side compartment when the end closure 14 is moved to the closed position for generally sealing this open end of the end or side compartment 21*a*.

The preferred embodiment of the present invention as above described is formed as an integral single injection molded unit which requires no further processing steps. While reference has been made to polypropylene as an example of the flexible thermoplastic synthetic polymer composition material from which the container or compact 10 can be formed, other synthetic materials have also been referred to, and those skilled in the art will readily recognize that other of the many synthetic plastics and resins which allow for the formation of integrally molded living hinges may also be used without departing from the spirit and scope of the present invention.

It will be understood that the invention is not to be limited to the specific construction or arrangement of parts shown but that they may be widely modified within the invention defined by the claims.

What is claimed is:

1. An integrally injection molded container formed of synthetic thermoplastic material comprising, a. base member means defining a storage compartment, and an enclosed side compartment disposed in general alignment with the storage compartment, b. said means defining the enclosed side compartment open at each respective opposite end thereof, and one of said open ends disposed in communication with the storage compartment, c. a first closure member connected by a living hinge to the base member means on the section thereof defining the storage compartment movable from an open position to a closed position for sealing the storage compartment, and d. said first closure member having a detachable latch means for holding the first closure means in the closed position, e. a second closure means connected by a living hinge to said base member means and disposed for closing and generally sealing the open end of said enclosed side compartment remote from the end in communication with the storage compartment, and f. said second closure member having a latch means for generally locking the second closure member in the closed position.

2. A container as claimed in claim 1 including, bracket means in the enclosed side compartment for holding an applicator, having a handle in the enclosed side compartment.

3. A container as claimed in claim 2 including, means on the container forming an access opening between the enclosed side compartment and the storage compartment to permit the handle of the applicator to extend into and overlie the storage compartment.

4. A container as claimed in claim 2 including, a. a first end wall in said base member means between the storage compartment and the enclosesd side compartment, b. a second end wall on said closure member disposed for matching engagement with the first end wall when said closure member is pivoted to closed position, c. a first notch means in said first end wall, d. a second notch means in said second end wall disposed to align with said first notch means in said first end wall when the closure member is pivoted to closed position, and e. said aligned first notch means and second notch means forming an opening for communication between a storage compartment and the enclosed side compartment when the closure member is in the closed position whereby the handle of the applicator can extend therethrough from the enclosed side compartment to overlie the storage compartment.

5. A container as claimed in claim 1 wherein the latch means for the second closure includes, a. an undercut section in the open end of the means forming the enclosed side compartment remote from the storage compartment, and b. the end of the second closure means biased for mating engagement with said undercut section.

6. A container as claimed in claim 5 wherein, a. the undercut section is at an angle of about 3°–5° to the longitudinal axes of the container, and b. the associate engaging end of the second closure means is biased at substantially the same angle.

7. A container as claimed in claim 1 wherein, a. the living hinge has shaped enlarged connecting sections on opposite sides hereof for connecting the living hinge respectively to the first closure member and the base member means, and b. said enlarged connecting sections disposed at an angle of 33° to the vertical plane of the container.

* * * * *